United States Patent [19]

Burke

[11] Patent Number: 4,694,967

[45] Date of Patent: Sep. 22, 1987

[54] DRAFTING TABLE ACCESSORY STORAGE ATTACHMENT DEVICE

[76] Inventor: Lawrence J. Burke, P.O. Box 306, Manhattan Beach, Calif. 90266

[21] Appl. No.: 853,360

[22] Filed: Apr. 17, 1986

[51] Int. Cl.[4] ..... A47F 3/14

[52] U.S. Cl. ..... 211/126; 211/13; 108/9

[58] Field of Search ..... 211/126, 170, 13, 69.1; 108/50, 9; 312/279, 196

[56] References Cited

U.S. PATENT DOCUMENTS

| | | | |
|---|---|---|---|
| 1,866,450 | 7/1932 | Burnley | 108/9 |
| 2,168,323 | 8/1939 | Bruen | 312/279 X |
| 2,846,808 | 8/1958 | Ivester | 108/9 |
| 2,860,404 | 11/1958 | Alden | 312/279 X |
| 3,271,044 | 9/1966 | Bosko et al. | 108/50 X |
| 3,721,349 | 3/1973 | Jaffee et al. | 211/126 |

FOREIGN PATENT DOCUMENTS

| | | | |
|---|---|---|---|
| 2414001 | 2/1975 | Fed. Rep. of Germany | 108/50 |
| 121936 | 4/1946 | Sweden | 108/50 |

*Primary Examiner*—Peter A. Aschenbrenner
*Attorney, Agent, or Firm*—Edward A. Sokolski

[57] ABSTRACT

An accessory storage device for various tools and accessories used in drafting such as triangles templates, lettering guides, pencil sharpeners, mechanical pencils, etc. is attached to the rear top portion of a drafting table. The device includes a frame which supports a light for illuminating the table and has an open top in which a tray for storing accessories is mounted. The frame has top and bottom portions which are pivotally attached to each other and an adjustment rod interconnecting these two portions and mounted slidably in one of the portions such that the top portion can be pivotally adjusted and set in a desired angular position relative to the bottom portion of the frame thereby permitting leveling of the top portion with various drafting table slant angles.

5 Claims, 6 Drawing Figures

DRAFTING TABLE ACCESSORY STORAGE ATTACHMENT DEVICE

This invention relates to attachment storage devices for drafting tables and more particularly to such a device having a tray for storing drafting aids and instruments.

It is highly desirable to provide means on a drafting table for supporting the various accessories and instruments required for drafting so that the draftsman can conveniently store such material and readily obtain it while using the table. Devices along these lines are shown in U.S. Pat. Nos. 3,142,129 to Stroop, 2,846,808 to Ivester, 1,953,026 to Scheuer, and 1,658,838 to Early. Each of these patents shows a different type of mechanism for holding and storing instruments and accessories. However, none of these patents shows a tray or other mechanism in which a whole series of triangles, pencil containers and the like can be conveniently held in place. The device of the present invention provides an improvement over prior art accessory storage devices for drafting tables in providing a simple frame structure which carries an elongated tray having slots and other openings formed therein for retaining a whole variety of drafting aids and instruments. Further, the device of the present invention includes means for leveling this tray to accommodate various slant angles for drafting tables on which the device of the invention may be mounted.

The improvement is achieved in the device of the invention by providing a frame structure having upper and lower portions which are pivotally attached to each other and which are interconnected by a sliding rod which can be moved vertically relative to one of the frame portions and locked in position when the two portions are in a desired angular relationship, thereby enabling leveling of the upper frame portion which carries the tray. The upper frame portion is open such that an elongated tray can be mounted therein, this tray having a plurality of slots and other openings for storing various drafting aids and accessories such as triangles, lettering guides, templates, pencil sharpeners, mechanical pencils, etc. Further, a light which may comprise a fluorescent lamp is mounted in the upper frame portion to provide illumination for the drafting board.

It is therefore an object of this invention to facilitate the mounting of drafting accessories and instruments on a drafting board.

It is a further object of this invention to provide a device for storing drafting instruments and accessories which can be attached to a drafting table and which has a tray for storing drafting aids and accessories thereon which can be adjustably positioned so that it is level with drafting tables having various inclination angles.

Other objects of the invention will become apparent as the description proceeds in connection with the accompanying drawings of which:

Figure 1:
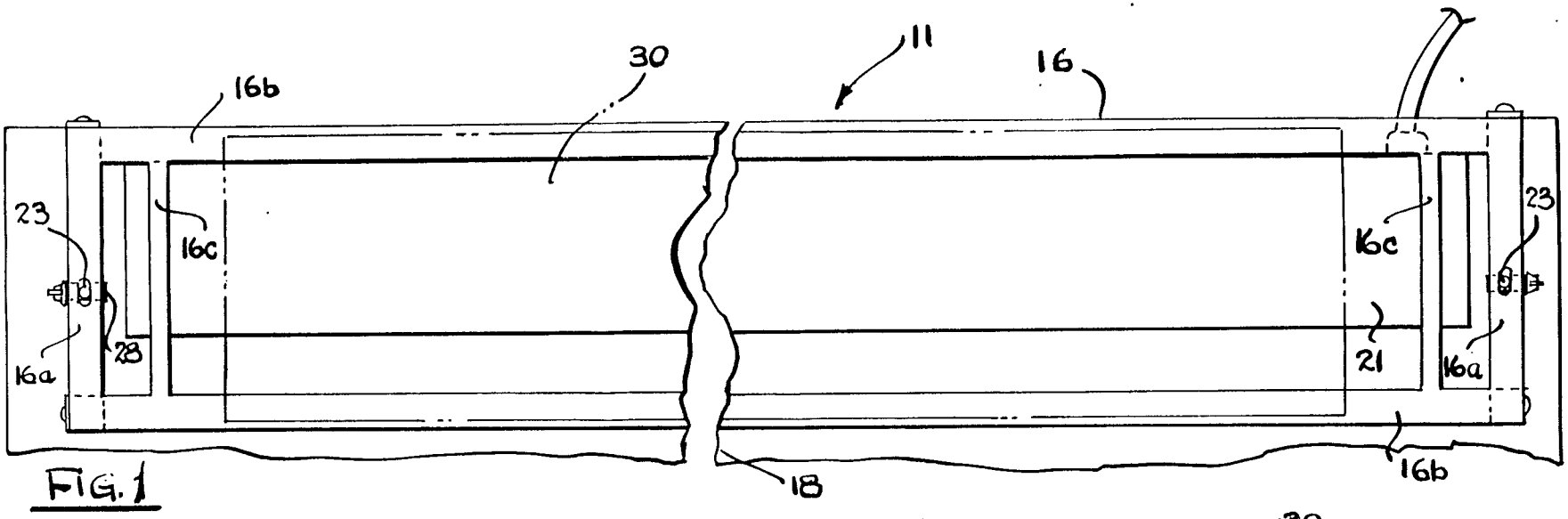
FIG. 1 is a top plan view of the preferred embodiment of the invention.
Figure 2:
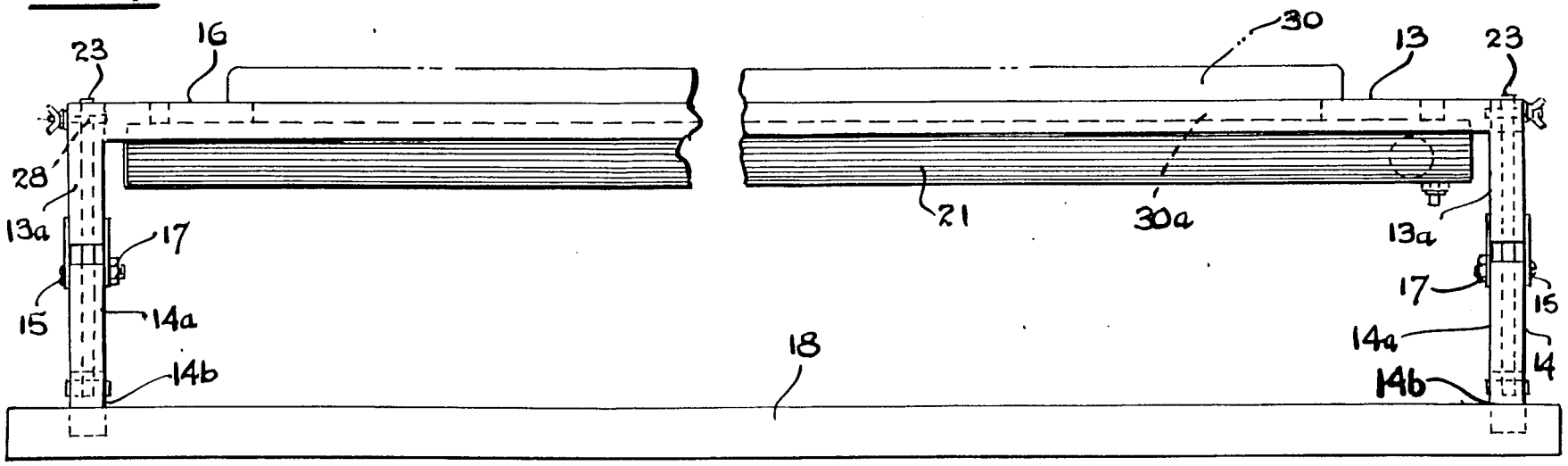
FIG. 2 is a front elevational view of the preferred embodiment.
Figure 3:
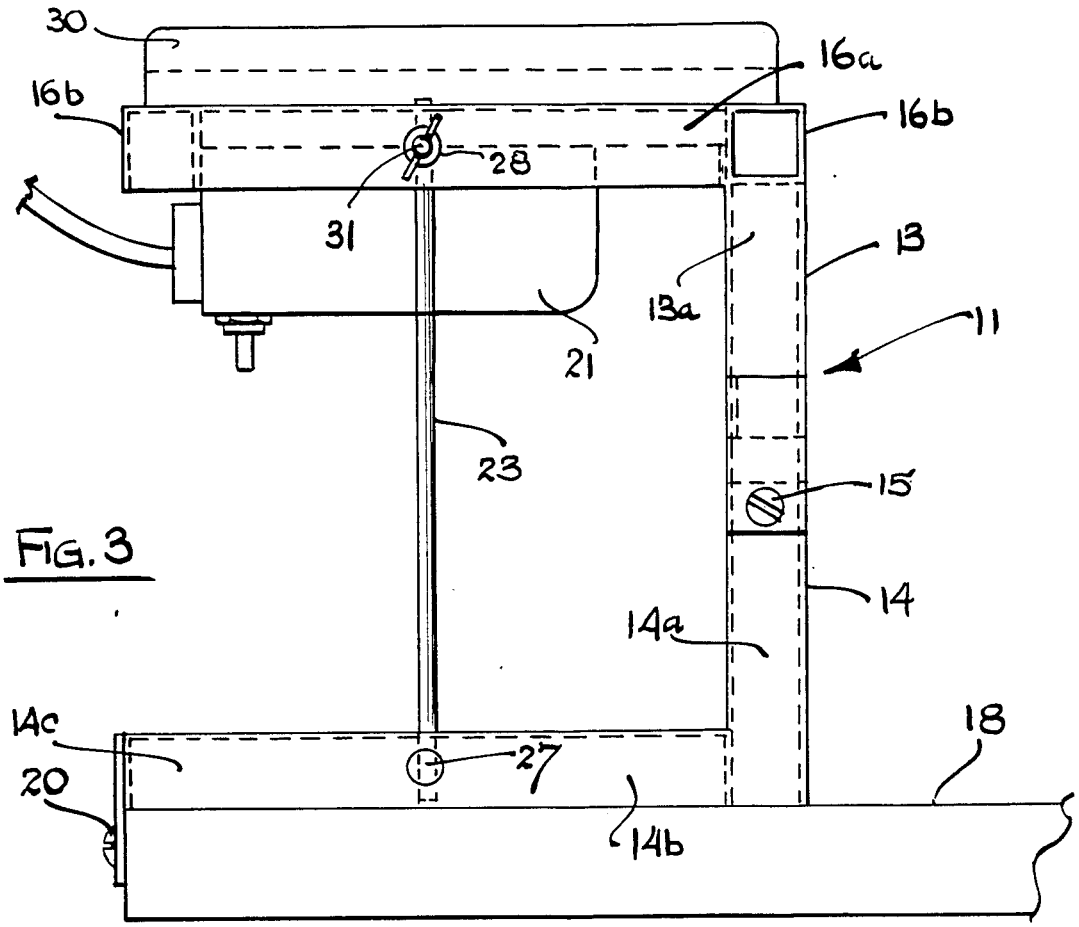
FIG. 3 is a side elevational view of the preferred embodiment.

Referring now to FIGS. 1-3, a preferred embodiment of the invention is illustrated. Frame 11 which may be fabricated of retangular metal tubing includes an upper section 13 and a lower section 14. the upper and lower frame sections have vertical arms 13*a* and 14*a* which are pivotally joined together at their ends by means of bolts 15 which fit through mating apertures formed in the arms. Bolts 15 are retained to the arms by means of nuts 17.

Lower frame section 14 has a pair of legs 14*b* extending normally from arms 14*a*. These legs have brackets 14*c* attached thereto, these brackets being attached to the rear edge of drafting table 18 by means of wood screws 20. In this manner, the lower frame section 14 is mounted on drafting table 18 with the legs 14*b* thereof flush with the top surface of table 18.

The upper frame section 13 has a rectangular top open frame structure 16 which includes a pair of opposing longitudinal arms 16*b* which are joined together by end cross arms 16*a*. A pair of cross struts 16*c* extend between longitudinal arms 16*b* inward of arms 16*a*, a fluorescent lamp 21 being mounted on struts 16*c*. A pair of rods 23 extend between cross arms 16*a* of the upper frame and leg members 14*b* of the lower frame. Rods 23 are fixedly attached at one end as for example by threadable attachment to trunnions 27 which are rotatably mounted in leg portions 14*b*. The upper ends rods 23 are slidably mounted in similar respective trunnions 28 which are rotatably supported in cross arms 16*a*. The rods are retained in a selected position in trunnions 28 by means of clamping screws 31 which can be tightened against the rods by means of wing grips on their ends.

Figure 3A:
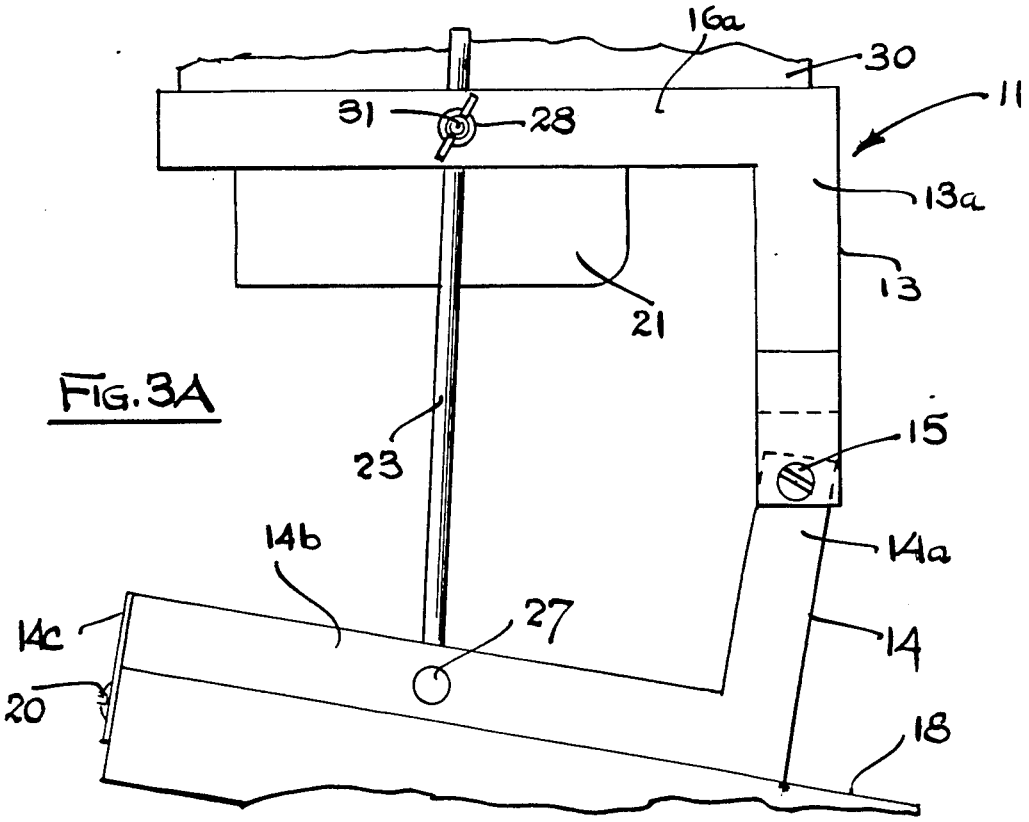
FIG. 3A is a side elevational view of the preferrred embodiment showing the frame adjusted to level the top portion of the frame where using an inclined drafting table.
Figure 4:
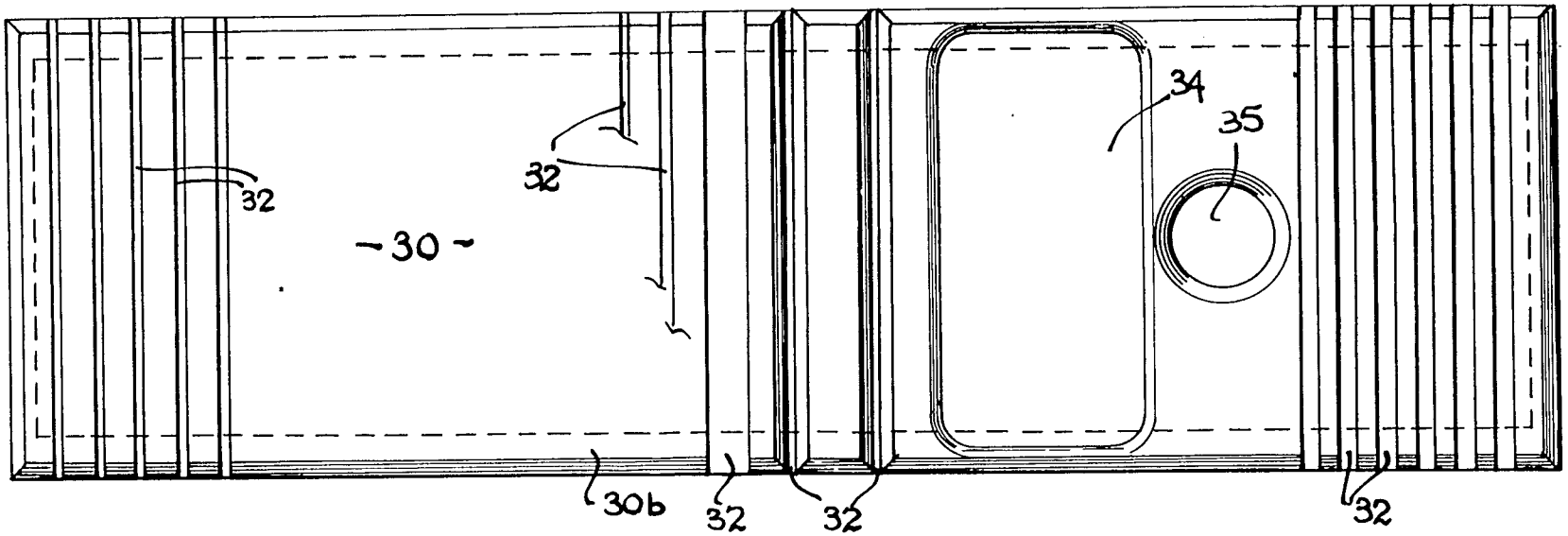
FIG. 4 is a top plan view of the tray of the preferred embodiment.
Figure 5:
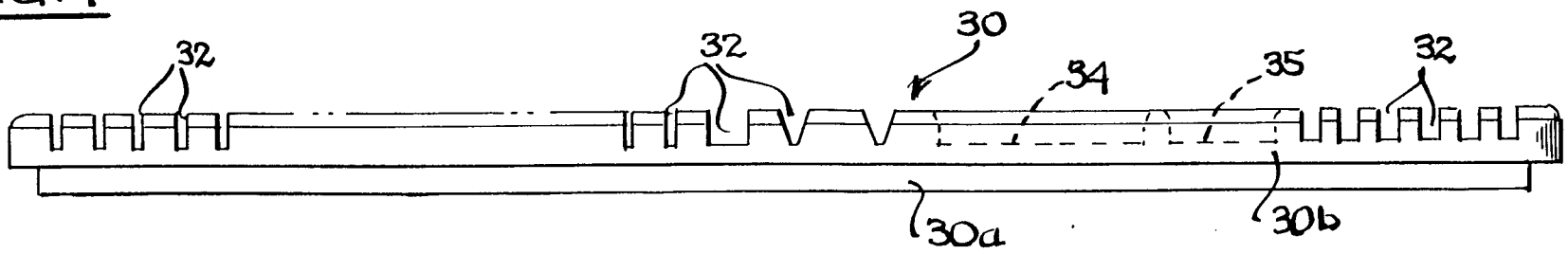
FIG. 5 is a front elevational view of the tray of FIG. 4.

As shown in FIG. 3A, upper and lower frame sections 13 and 14 can be pivotally adjusted relative to each other to accommodate the slant angle of drafting board 18. This end result is achieved by loosening screws 15 and 31 and pivotally moving the two frame sections relative to each other with the rods 23 riding up through their trunnions 28 until the proper positioning is achieved, at which time screws 15 and 31 are tightened to retain the upper and lower frame sections in the desired relative position as, for example, shown in FIG. 3A Referring now to FIGS. 4 and 5, tray 30 which may be fabricated of wood or plastic has a bottom undercut or indented portion 30*a* which nests in the open top portion 16 of the upper frame section as shown in FIG. 2. The top surface 30*b* of the tay has a plurality of transverse slots 32 formed therein. These slots are of various widths for accommodating drafting aids and tools such as triangles, lettering guides, templates, rulers, etc. Certain ones of these slots may be tapered to accommodate certain types of drafting instruments. Further, a flat rectangular portion 34 is provided to accommodate pencils and the like and a circular portion to accommodate an ink bottle, etc.

While the invention has been described and illustrated in detail, it is to be clearly understood that this is intended only by way of illustration and example and is not to be taken by way of limitation, the spirit and scope of the invention being limited only by the terms of the following claims:

I claim:

1. An accessory and storage attachment for a drafting table comprising:

an upper frame section including a rectangular top open frame structure formed by a pair of opposing longitudinal arms joined together at their opposite ends by a pair of opposing cross arms, and a pair of vertical arms extending normally from the opposite ends of one of said longitudinal arms;

a lower frame section formed by a pair of similar opposing frame members, each of such frame members including a vertical arm and a leg fixedly attached to and extending normally from said vertical arm;

means for pivotally connecting one end of each of the vertical arms of said lower frame section to one end of a respective one of the vertical arms of said upper frame section;

a tray having a plurality of slots formed therein for use in mounting drafting tools and accessories on said tray, said tray having an indented portion formed therein;

said tray being supported on said upper frame section, with the indented portion thereof nested in the top open frame structure;

means for setting the vertical arms of said upper and lower frame sections in a preselected angular position relative to each other, and means for attaching the legs of the lower frame member to said drafting table.

2. The device of claim 1 wherein the means for setting the vertical arms in a preselected pivotal position comprises a rod pivotally connected to each of the legs of said lower frame section, each of said rods being pivotally connected to an opposing portion of the frame structure of the upper frame section, said rods being slidably mounted in one of said frame sections and means for selectively clamping said rods to said one of said frame sections in a selected fixed position relative thereto which corresponds to said preselected pivotal position.

3. The device of claim 2 and further including trunnions for pivotally connecting the rods to the frame sections, the trunnions being pivotally mounted in said frame sections.

4. The device of claim 1 and further including a lamp, the top open frame structure having a pair of cross struts, said lamp being supported between said cross struts.

5. The device of claim 3 wherein said rods are slidably mounted in the trunnions mounted in the upper frame section and fixedly mounted in the trunnions mounted in the lower frame section.

* * * * *